US007207342B1

(12) United States Patent
Daniels

(10) Patent No.: US 7,207,342 B1
(45) Date of Patent: Apr. 24, 2007

(54) PORTABLE PACIFIER CLEANSING DEVICE

(76) Inventor: Terry Daniels, 15507 S. Normandie Ave. #243, Gardena, CA (US) 90247

( * ) Notice: Subject to any disclaimer, the term of this patent is extended or adjusted under 35 U.S.C. 154(b) by 298 days.

(21) Appl. No.: 10/962,232

(22) Filed: Oct. 12, 2004

(51) Int. Cl.
*B08B 3/02* (2006.01)

(52) U.S. Cl. ..... 134/111; 134/135; 134/199

(58) Field of Classification Search ..... 134/901, 134/199, 135, 111
See application file for complete search history.

(56) References Cited

U.S. PATENT DOCUMENTS

| | | | | | |
|---|---|---|---|---|---|
| 2,163,862 | A * | 6/1939 | Wing | 134/137 |
| 2,664,854 | A * | 1/1954 | Talbot | 118/417 |
| 3,006,687 | A * | 10/1961 | Brandon | 297/153 |
| 3,167,079 | A * | 1/1965 | Weil | 134/137 |
| 3,280,828 | A * | 10/1966 | Stiel | 134/117 |
| 3,894,551 | A * | 7/1975 | Stohlman | 134/135 |
| 3,964,926 | A * | 6/1976 | Westphal | 134/117 |
| 4,192,307 | A * | 3/1980 | Baer | 606/236 |
| 4,700,729 | A * | 10/1987 | Thaler | 134/139 |
| 4,721,124 | A * | 1/1988 | Tuerkheimer et al. | 134/138 |
| 4,784,167 | A * | 11/1988 | Thomas et al. | 134/93 |
| 4,857,130 | A * | 8/1989 | Curtis | 156/292 |
| 5,000,209 | A * | 3/1991 | Mann | 134/135 |
| 5,164,166 | A * | 11/1992 | Stepanski et al. | 422/297 |
| 5,402,810 | A * | 4/1995 | Donley | 134/135 |
| 6,343,612 | B1 * | 2/2002 | Dahl | 134/117 |
| 6,390,104 | B1 * | 5/2002 | Gagnon | 134/107 |

* cited by examiner

*Primary Examiner*—Frankie L. Stinson
(74) *Attorney, Agent, or Firm*—Albert O. Cota

(57) ABSTRACT

A portable cleansing device (20) for cleaning small items, such as a pacifier (80), with pressurized liquid. The invention consists of a container (22) with a lid (46) that is removably attached to the container for maintaining liquid-tight integrity. A vertical partition (52) within the container forms a fresh liquid reservoir (56) for storing fresh water and a waste liquid repository (64) for storing waste water. A cleaning chamber (68) is formed having an inner wall (70) that is spaced from the container to create a void (72) therebetween that incorporates a number of nozzle openings (74). A liquid pump (78) is attached to the container and is in fluid communication with the void and with the fresh liquid reservoir. When the pump is manually energized, water is forced from the reservoir through the nozzles, thus spraying pressurized water onto the object positioned within the cleaning chamber, with the water accumulating and stored in the repository beneath the chamber.

15 Claims, 7 Drawing Sheets

PORTABLE PACIFIER CLEANSING DEVICE

TECHNICAL FIELD

The invention generally pertains to cleaning and storing small items such as pacifiers and more specifically to a device that utilizes a container having fresh pressurized liquid for cleaning and a means for storing of the waste liquid after use.

BACKGROUND ART

Previously, many types of containers having the capability of washing or cleaning a pacifier or pacifiers have been used to provide an effective means for cleansing a pacifier after usage by an infant. Storage of a pacifier in conjunction with the cleaning capabilities has also been taught by prior art.

A search of the prior art did not disclose any patents that possess the novelty of the instant invention; however the following U.S. patents are considered related:

| Patent Number | Inventor | Issue Date |
|---|---|---|
| 3,894,551 | Stohlman | Jul. 15, 1975 |
| 4,054,220 | Rosenstein | Oct. 18, 1977 |
| 5,402,810 | Donley | Apr. 4, 1995 |
| 5,839,457 | Rijken et al. | Nov. 24, 1998 |
| 6,343,612 | Dahl | Feb. 5, 2002 |
| 6,708,363 | Larsen | Mar. 23, 2004 |

Stohlman in U.S. Pat. No. 3,894,551 teaches a container for use in cleansing jewelry utilizing a basket that is supported in an elevated position to hold the jewelry. Covers prevent the jewelry from being dislodged during submerging and a support allows the jewelry to drip.

U.S. Pat. No. 4,054,220 issued to Rosenstein is for a portable pocket flask for cleaning and refreshing dentures. The flask has two sealed compartments: one that is padded for the dentures and one that contains rinsing fluid such as mouthwash or water.

Donley in U.S. Pat. No. 5,402,810 discloses a portable apparatus for storing and cleaning pacifiers that includes a rack within a vessel. The apparatus utilizes cleaning fluid to clean the pacifiers by moving the vessel so that fluid flows over the bulb of the pacifier.

Rijken et al. in U.S. Pat. No. 5,839,457 teaches a device for rinsing objects utilizing elastic bellows within a reservoir.

U.S. Pat. No. 6,343,612 issued to Dahl is for an apparatus that is used to clean and store pacifiers that includes a cylindrical body having top and bottom compartments with screw on lids. The top lid has a channel for attaching a strap to a stroller or other locations. The top compartment contains a cleaning liquid and the bottom compartment is for storage.

Larsen in U.S. Pat. No. 6,708,363 discloses a pacifier cleaner that comprises a container with a removable insert. The insert cleans the nipple and inner surface of a pacifier's base with a cleaning liquid. The insert may have clustered bristles, fingerlike extensions or flocked fibers. The pacifier base cleaning surface may have a convex shape to correspond to the shape of the inner surface of the pacifier's base.

For background purposes and as indicative of the art to which the invention is related reference may be made to the remaining cited U.S. Pat. No. 2,163,862 issued to Wing.

DISCLOSURE OF THE INVENTION

It is apparent that the need for a device that is capable of cleaning a pacifier has been recognized and therefore numerous devices have been developed to fill this requirement as outlined in the above description of the prior art. This need apparently has not been completely solved, as there are very few devices on the market that are successful enough to be generally available. Therefore the primary object of the invention is to provide a device that is readily accessible when a young child or toddler drops their pacifier onto the ground where it attracts dust, dirt or debris, particularly since the pacifier is often wet and sticky. In many cases the child or toddler simply picks it up and puts it back into their mouth without even wiping it off. The convenience of the invention is of utmost importance as it must be available at the appropriate time. Most mothers or guardians do not normally carry water or means for wiping the pacifier clean since it requires a liquid in a sealed container with cleaning provisions. It will be clearly envisioned that the present invention provides the desired convenience.

An important object of the invention is that it promotes hygiene for the child or toddler, as it prevents microorganisms such as bacteria, virus, fungus, etc. from being passed from easily contaminated sources. It is well known that children are susceptible to a wide variety of maladies that are transmitted from such sources.

Another object of the invention is the compact nature of the invention, as it is in the shape of a container that is not much larger in diameter than the pacifier itself and only about double the height. Further, the size is sufficient to supply enough water, as the cleaning media, to provide numerous cleansing procedures, as the spray technique requires only a minimal amount of liquid per cleaning. The invention also provides a waste water repository which is integral with the device storing the expended water until the fresh water is depleted by use.

Still another object of the invention is the lightweight nature of the invention, as it is constructed of thermoplastic in the form of a relatively thin wall cylindrical container with a screw on lid. A manual pump that is attached to the container's side is small and also made of the same material, with the exception of the necessary stainless steel compression springs and shafts. Since only a small amount of water is required the total weight is negligible. The invention fits into a purse, diaper bag or may be attached to a stroller or the like with a strap, string or any flexible cord which extends from the handle located on top of the lid.

Yet another object of the invention is that it is user friendly since it is very easy to understand its functional operation. Once the user recognizes that the clean water is poured into a liquid-tight stopper that is located above the reservoir and the pacifier is to placed in the cleaning chamber, the remaining functional operation is intuitively obvious. The manual pump in both of its embodiments is very well known in the art and is used in countless spray bottles and lotion dispensers, therefore no explanation is necessary. Draining the waste water is also easily understood, as the container may be turned upside down and drained or flushed as required when filling the reservoir.

A final object of the invention is that the manufacturing process can be accomplished with injection molding which is cost effective when sufficient quantity is produced. Once the initial cost of tooling is recovered by amortizing over a large production run, the individual cost to the user is well within the reach of most consumers.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
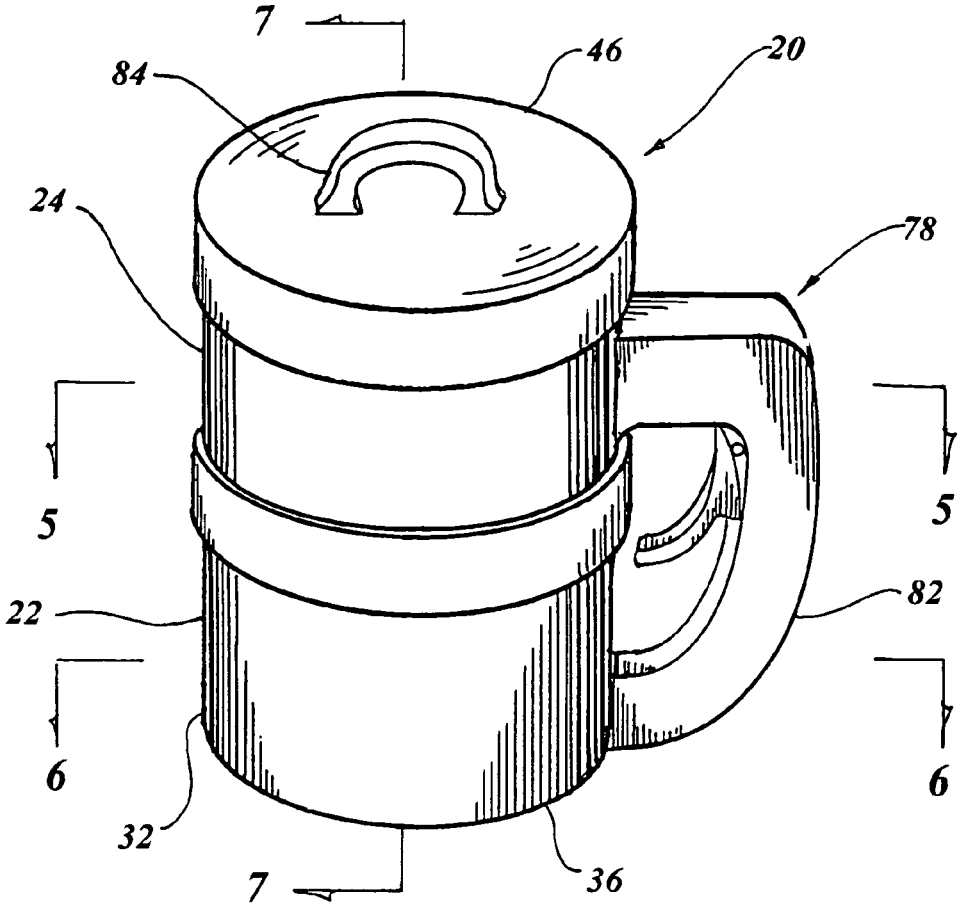
FIG. 1 is a partial isometric view of the preferred embodiment.

The best mode for carrying out the invention is presented in terms of a preferred and a second embodiment for a portable pacifier cleaning device. Both embodiments are essentially the same except for the type of pump used to spray liquid for cleaning.

The preferred embodiment of the portable pacifier cleansing device 20, as shown in FIGS. 1 through 7, is comprised of a liquid-tight container 22 having an upper portion 24, as illustrated in FIGS. 1–4, which includes a top 26, a bottom 28 and a vertical wall 30. A lower portion 32 of the container 22 also includes a top 34, a bottom 36 and a vertical wall 38. The liquid-tight container 22 is preferably in a cylindrical shape, as depicted in the drawings, however it may be square, oval, polygonal or any other shape. The upper portion 24 is round on the top 26, as it preferably utilizes a plurality of cylinder threads 40 on its upper outer edge, as shown in FIGS. 2–4 and 7.

Figure 2:
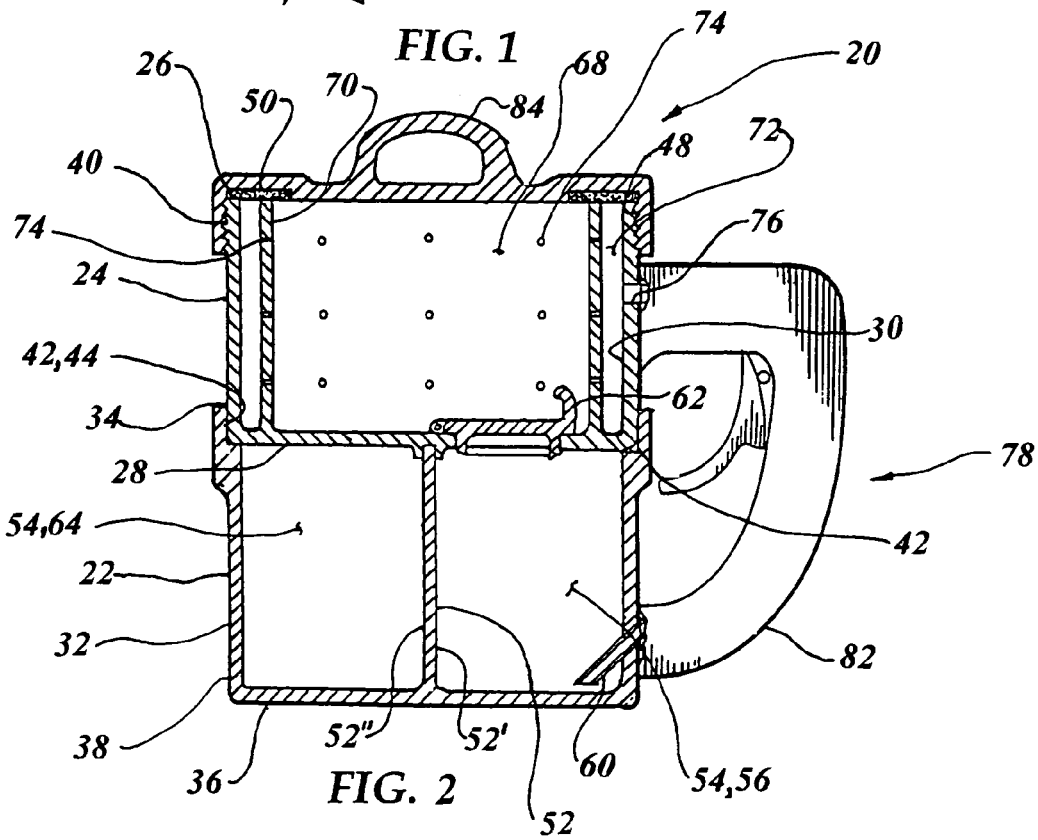
FIG. 2 is a cross-sectional view taken along an arbitrary horizontal centerline of FIG. 1 with the pump illustrated as viewed from the outside.
Figure 3:
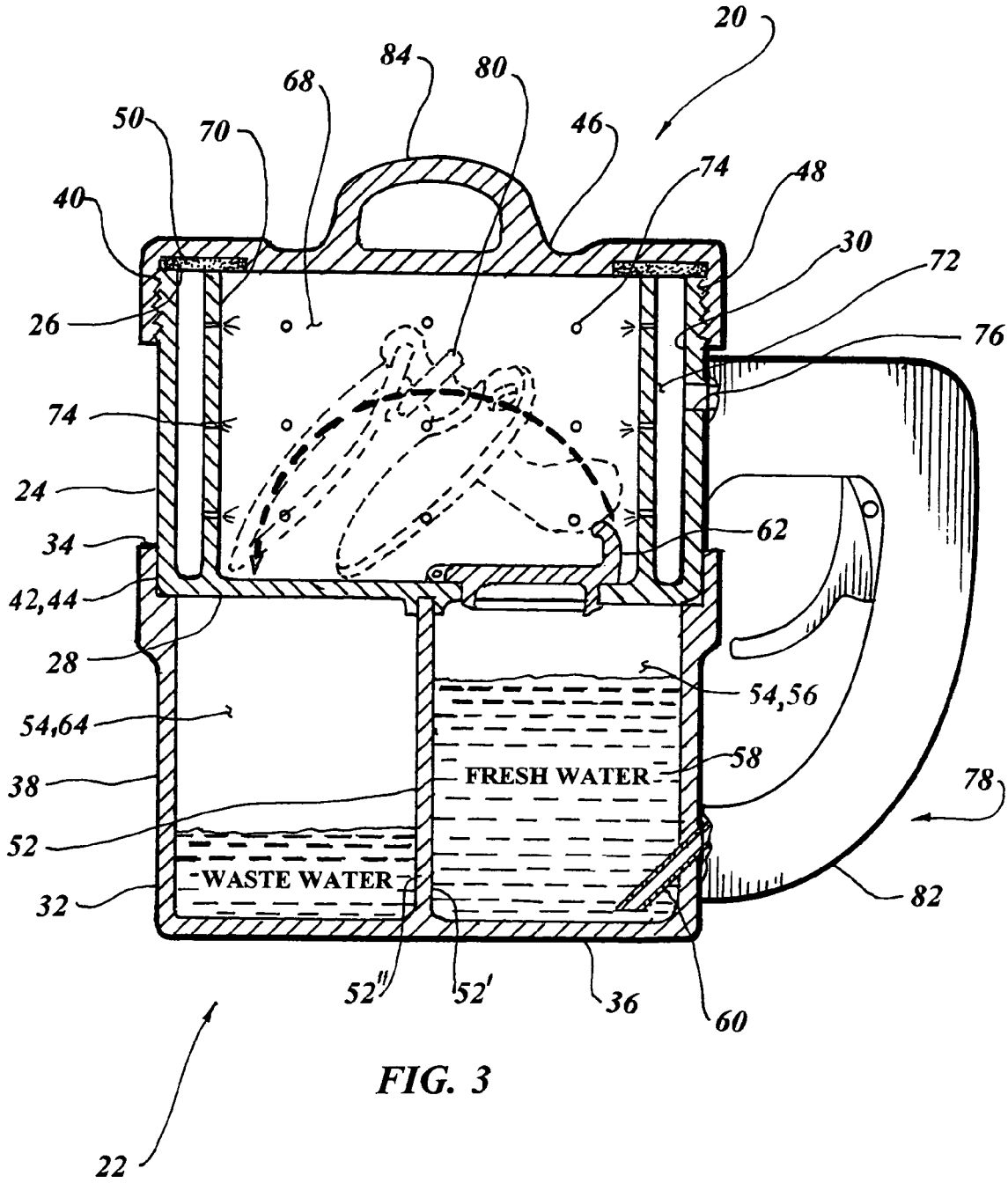
FIG. 3 is an enlarged cross-sectional view taken along an arbitrary horizontal centerline of FIG. 1 illustrating water in the reservoir and repository, also a pacifier is shown within the cleaning chamber in dotted lines as it is not part of the invention.
Figure 4:
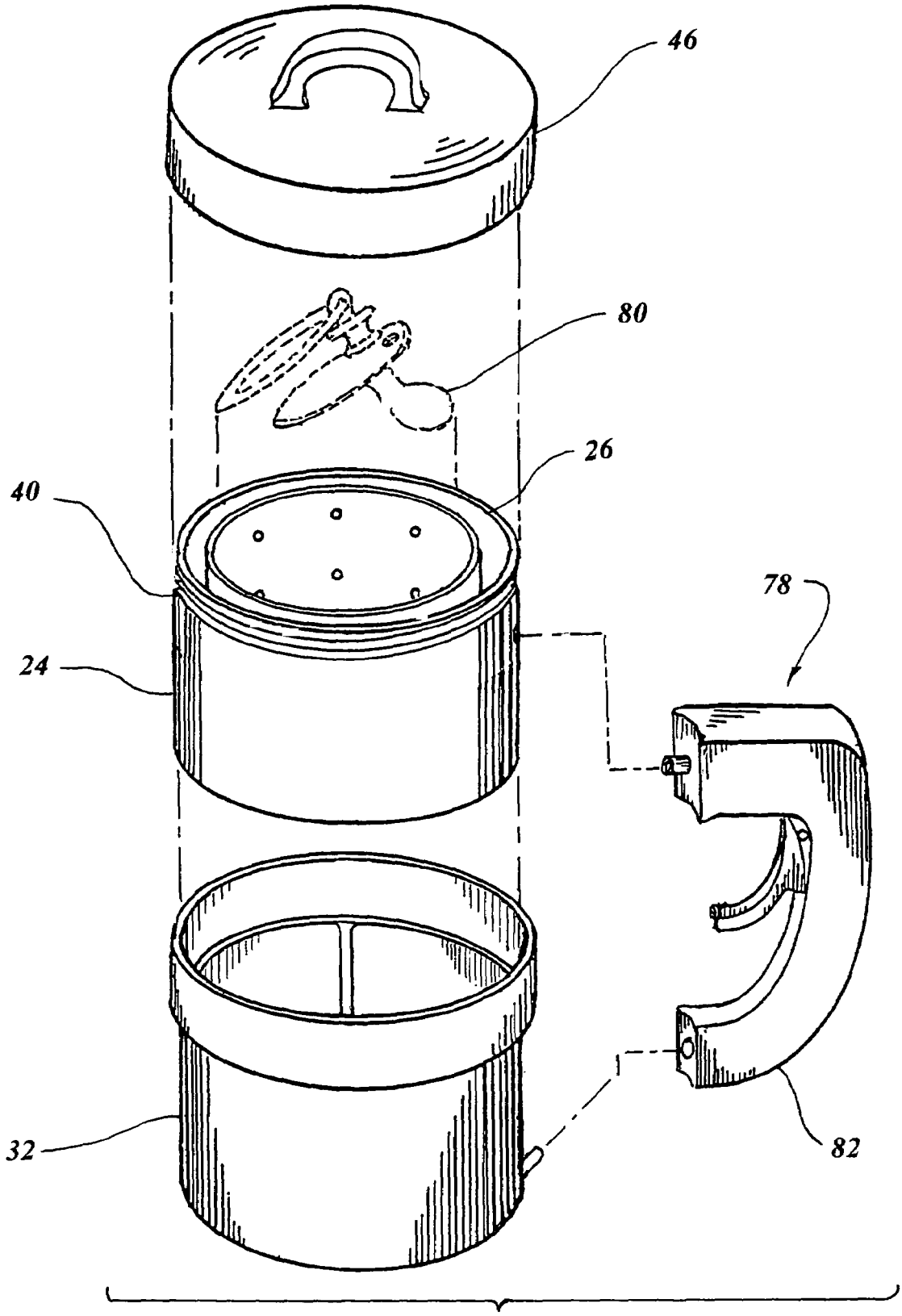
FIG. 4 is an exploded partial isometric view of the preferred embodiment.
Figure 5:
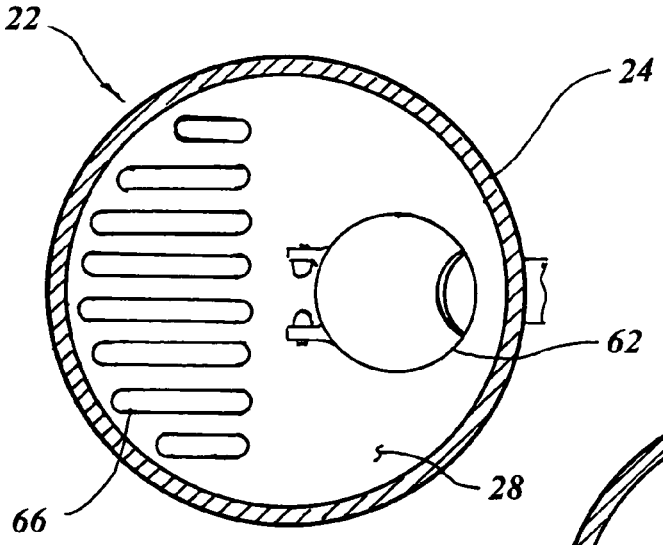
FIG. 5 is a cross-sectional view taken along lines 5—5 of FIG. 1 with the pump partially cutaway.
Figure 6:
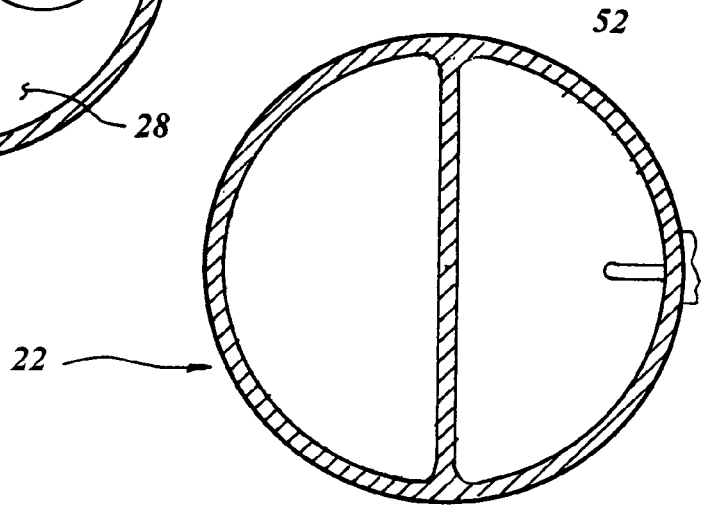
FIG. 6 is a cross-sectional view taken along lines 6—6 of FIG. 1 with the pump partially cutaway.
Figure 7:
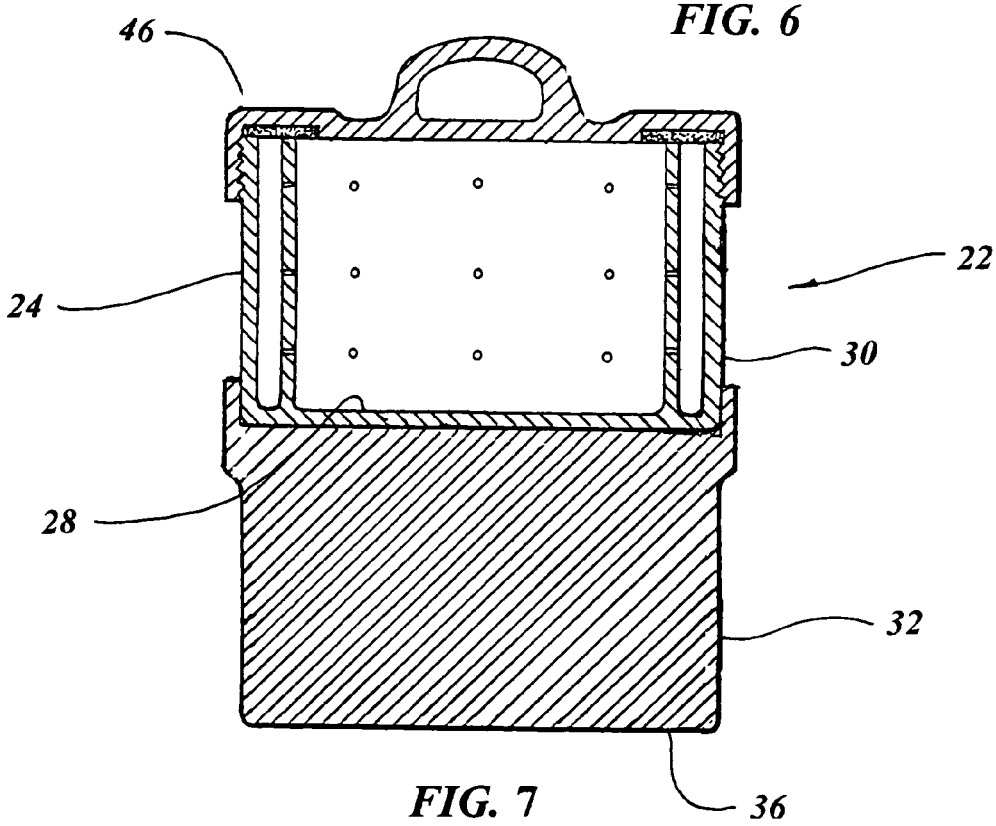
FIG. 7 is a cross-sectional view taken along lines 7—7 of FIG. 1.
Figure 8:
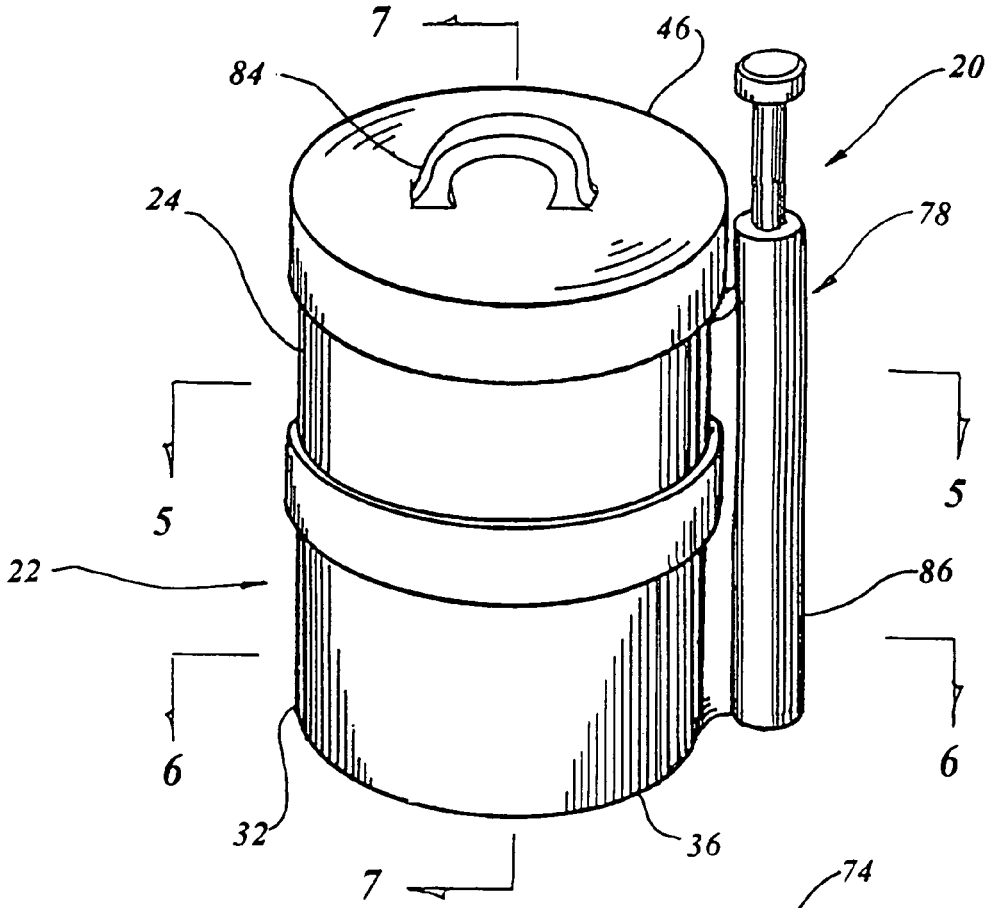
FIG. 8 is a partial isometric view of the second embodiment.
Figure 9:
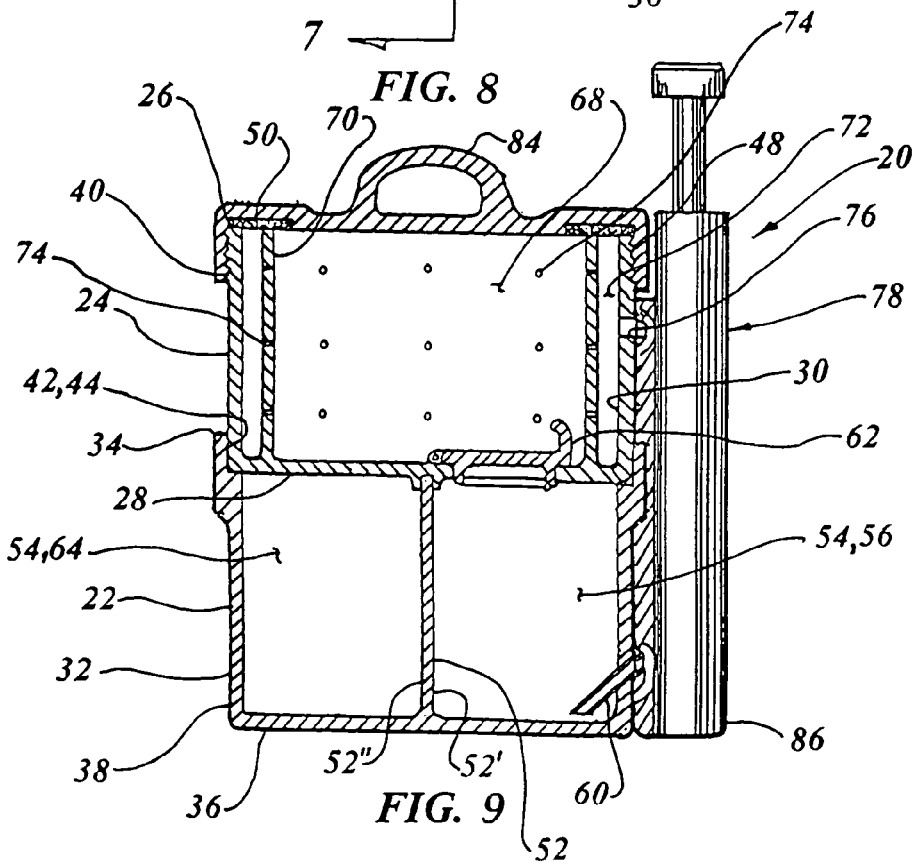
FIG. 9 is a cross-sectional view taken along an arbitrary horizontal centerline of FIG. 8 with the pump illustrated as viewed from the outside.
Figure 10:
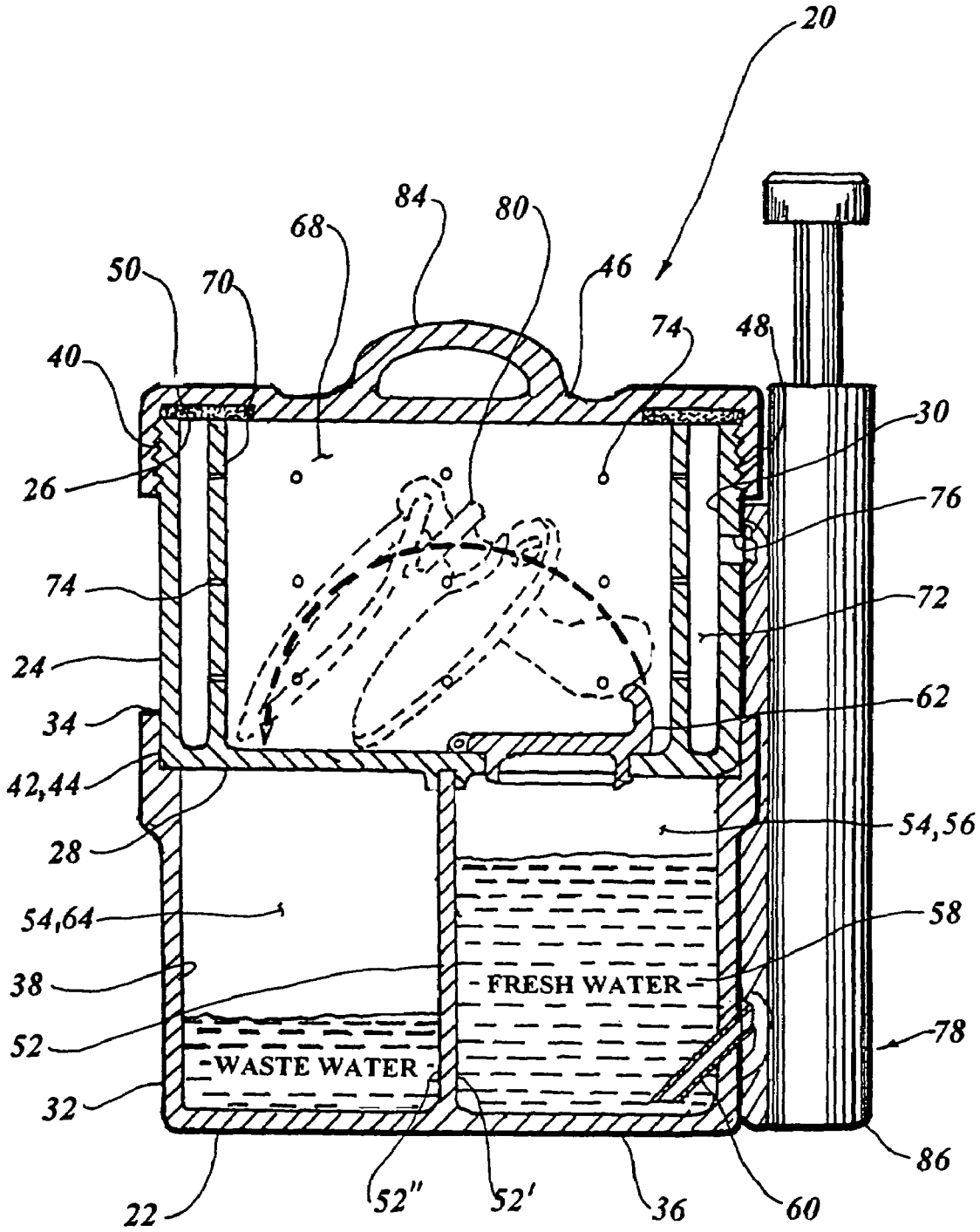
FIG. 10 is an enlarged cross-sectional view taken along an arbitrary horizontal centerline of FIG. 8 illustrating water in the reservoir and repository, also a pacifier is shown within the cleaning chamber in dotted lines as it is not part of the invention.
Figure 11:
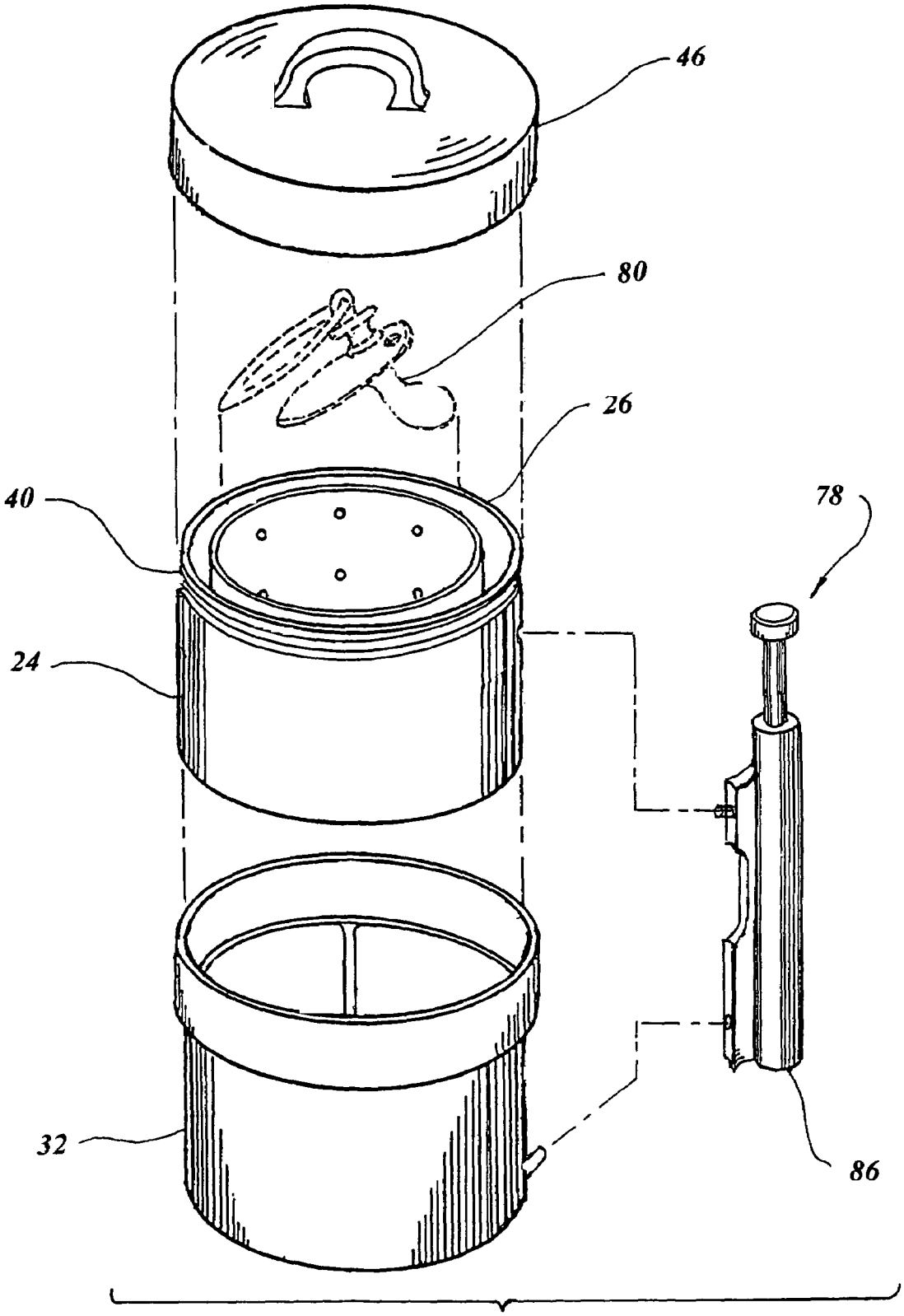
FIG. 11 is an exploded partial isometric view of the second embodiment.

The upper portion 24 and lower portion 32 are attached together to form the cylindrical shape, as depicted in FIGS. 1–3, with a socket 42 formed integrally with the lower portion 32 that permits the upper portion 24 to slip inside. A permanent bond 44 attaches the upper portion 24 to the lower portion 32 in the form of an adhesive, welding the joint together with heat, or a solvent melting the parent material. The purpose of fabricating the cylindrical container in two separate pieces is to permit the use of an injection molding process which has limitations as to forming chambers and perorations within walls.

A lid 46 is removably attached to the upper portion 24 of the liquid-tight container 22 to maintain liquid-tight integrity for storage and transportation. The lid 46 includes a plurality of lid threads 48 that mate with cylinder threads 40, thus permitting the lid 46 to be screwed on to the cylinder 22 for a removable attachment therebetween. The lid 46 further incorporates a gasket 50 that is configured to interface with the top 26 of the upper portion 24 of the container 22 in a liquid-tight manner. The gasket 50, as illustrated best in FIGS. 3 and 7, fits tightly into the lid or may be glued or vulcanized in place.

A vertical partition 52 is integrally formed in the lower portion 32 of the liquid-tight container 22, with the partition 52 having a first side 52' and a second side 52". The partition 52 creates a pair of identical open cavities 54 since the partition 52 is located essentially in the middle of the lower portion 32.

A fresh liquid reservoir 56 is formed between the first side 52' of the vertical partition 52 and the lower portion vertical wall 38 for storing a fresh liquid therein, which is preferably fresh water 58. The fresh liquid reservoir 56 further contains a liquid inlet opening, preferably embodied as an inlet tube 60, that penetrates the vertical wall 38 adjacent to the lower portion bottom 36, as illustrated in FIGS. 2 and 3. The bottom 36 of the lower portion 32 of the container 22 is positioned over the container's fresh liquid reservoir 56. A liquid-tight stopper 62 is removably disposed within an opening within the bottom 36, thereby permitting liquid to be filled from the top of the container 22 when the lid 46 is removed. The stopper 62 may be removed by hand or optionally may be hinged, as illustrated in FIG. 3.

A waste liquid repository 64 is formed between the partition's second side 52" and the container's vertical wall 38 for storing waste liquid. The bottom 28 of the upper portion 24 of the container 22 is positioned over the waste liquid repository 64 and contains an open grill 66 that extends through into the repository 64 to permit waste liquid to drain and collect therein.

A pacifier cleaning chamber 68 is formed within the upper portion 24 of the liquid tight container 22, as illustrated in FIGS. 2–4 and 7. The chamber 68 has an inner wall 70 that is spaced away from upper portion vertical wall 30, thus forming a void 72 therebetween having a plurality of nozzle openings 74 that penetrates through the wall 70. The pacifier cleaning chamber 68 also includes a liquid inlet opening 76 in the upper portion's vertical wall 30 that is used to receive fluid into the void 72 created by the inner wall 70.

A manual liquid pump 78 is formed integrally or bonded with adhesive, or the like, to an outer surface of the vertical wall of the container 22. The pump 78 is in fluid communication with the void 72 formed between the cleaning chamber's 68 vertical wall 30 and the chamber's inner wall 70 through the liquid inlet opening 76. The pump 78 also communicates with the fresh liquid reservoir 56 through the inlet tube 60. When the pump 78 is manually energized, fluid is forced from the reservoir 56 into the void 72 and then through the nozzle openings 74, which sprays liquid onto a pacifier 80 that has been positioned within the cleaning chamber 68. The high pressure liquid impinges directly on the majority of surfaces of the pacifier 80, thus cleansing the pacifier 80 by washing off the dirt and debris. The waste liquid then drains through the open grille 66 and accumulates in the repository 64 directly beneath the chamber 68.

The manual liquid pump 78 in the preferred embodiment is preferably the well-known finger lever operated type 82, as shown in FIGS. 1–7.

It may be clearly envisioned that the cleansing device 20 is best fabricated using the injection molding process. Therefore, at the least the liquid tight container 22 and lid 46 are formed of a thermoplastic material such as polyethylene, polycarbonate, polypropylene, polystyrene, ABS, polyvinyl chloride or cellulose. The pump 78 may also be fabricated of the same material, along with metallic springs and pins and other non-plastic conventional components. The stopper 62 may be made of the same material in the softer formulations or even a synthetic rubber or the like.

For convenience, a handle 84 may be optionally added to the container 22 or lid 46, as shown, thereby permitting the device 20 to be attached to a convenient object. The handle 84 is preferably integrally formed into the adjoining element and has an opening sufficiently wide to receive a strap or the like for attachment purposes.

The second embodiment of the invention, as illustrated in FIGS. 5–11, is identical as far as the container 22, lid 46 and internal features are concerned however the manual liquid pump 78 is the thumb pressure actuating type 86, which is also well known in the art, particularly in spray bottles. As the elements are identical, the same reference designations are used in the drawings for both embodiments illustrated and the function is indistinguishable.

While the invention is directed to cleaning a pacifier 80, it is not the only item that could be cleaned within the device, as the device with its functional operation could be adapted to clean almost any object that is small enough to fit inside the chamber 68. Further, while water is preferred to clean the pacifier 80, any soap, solvent or cleaning solution may also be utilized for other items.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

The invention claimed is:

1. A portable pacifier cleansing device for cleaning small items which comprises:

a) a liquid-tight container having an upper portion including a top, a bottom and a vertical wall, and a lower portion including a top, a bottom and a vertical wall, b) a lid removably attached to said upper portion of said liquid-tight container to maintain the device's liquid-tight integrity, c) a vertical partition integrally formed in said lower portion of said liquid-tight container, said partition having a first side and a second side, with the partition creating a pair of open cavities, d) a fresh liquid reservoir formed between said first side of the vertical partition and said container vertical wall, for storing fresh liquid therein, e) a waste liquid repository formed between said second side of the vertical partition and said container vertical wall, for storing waste liquid therein, f) a pacifier cleaning chamber formed within said liquid-tight container, said chamber having an inner wall spaced from said container's vertical wall which forms a void therebetween, with said inner wall having a plurality of nozzle openings penetrating therethrough, and g) a manual liquid pump that is attached to an outer surface of the container's vertical wall and is in fluid communication with said void formed between said chamber container's vertical wall and said chamber's inner wall, in communication with said fresh liquid reservoir such that when the pump is manually energized fluid may be forced from the reservoir through the nozzles, thereby spraying liquid onto a pacifier positioned within the cleaning chamber, with the liquid cleansing the pacifier and accumulating in the repository beneath the chamber.

2. The portable pacifier cleansing device as recited in claim 1 wherein said liquid tight container and lid are formed of a thermoplastic material.

3. The portable pacifier cleansing device as recited in claim 2 wherein said thermoplastic material is selected from the group consisting of: polyethylene, polycarbonate, polypropylene, polystyrene, ABS, polyvinyl chloride and cellulose.

4. The portable pacifier cleansing device as recited in claim 1 wherein said liquid-tight container further having a cylindrical shape and said upper portion having a plurality of cylinder threads on an upper outer edge.

5. The portable pacifier cleansing device as recited in claim 4 wherein said liquid-tight container further comprises a permanent bond that attaches the upper portion to the lower portion, thus forming an integral cylinder.

6. The portable pacifier cleansing device as recited in claim 5 wherein said lid further comprises a plurality of lid threads that mate with said cylinder threads, thereby permitting the lid to be screwed on to the cylinder for attachment therebetween.

7. The portable pacifier cleansing device as recited in claim 1 wherein said lid further comprises a gasket configured to interface with the container in a liquid-tight manner.

8. The portable pacifier cleansing device as recited in claim 1 wherein said vertical partition is located essentially in a middle position of the lower portion of said container.

9. The portable pacifier cleansing device as recited in claim 1 wherein said fresh liquid reservoir further having a liquid inlet tube that penetrates said vertical wall adjacent to the bottom of the lower portion.

10. The portable pacifier cleansing device as recited in claim 1 wherein the bottom of the upper portion is positioned over said container fresh liquid compartment, and the bottom of the upper portion further comprises a liquid-tight stopper removably disposed within said bottom, thus permitting liquid to be introduced into the compartment when the stopper is opened and retained in the compartment when the stopper is closed, which maintains the liquid within the compartment regardless of the orientation of the cleansing device.

11. The portable pacifier cleansing device as recited in claim 1 wherein the bottom of the upper portion is positioned over said container's liquid repository, and the bottom of the upper portion further having an open grill over said container liquid repository, thereby permitting waste liquid to drain into the repository therebeneath.

12. The portable pacifier cleansing device as recited in claim 1 wherein said pacifier cleaning chamber further having a liquid inlet opening in the upper portion of said vertical wall for receiving fluid from the manual liquid pump attached to an outer surface of the container's vertical wall.

13. The portable pacifier cleansing device as recited in claim 1 wherein said manual liquid pump further comprises a finger lever operated type of pump.

14. The portable pacifier cleansing device as recited in claim 1 wherein said manual liquid pump further comprises a thumb pressure actuating type of pump.

15. A portable cleansing device for cleaning small items with pressurized water which comprises:

a container, a lid removably attached to said container for maintaining liquid-tight integrity, a vertical partition in said liquid-tight container, a fresh liquid reservoir formed by said partition for storing fresh liquid therein, a waste liquid repository formed by said partition for storing waste liquid therein, a cleaning chamber formed within said container having a inner wall spaced from said container to create a void therebetween having a plurality of nozzle openings penetrating therethrough, and a liquid pump that is attached the container and is in fluid communication with said void and said fresh liquid reservoir such that when the pump is manually energized liquid may be forced from the reservoir through the nozzles, thus spraying liquid under pressure onto an object positioned within the cleaning chamber with the liquid accumulating and stored in the repository beneath the chamber.

* * * * *